US010087024B2

(12) United States Patent
Padros et al.

(10) Patent No.: US 10,087,024 B2
(45) Date of Patent: Oct. 2, 2018

(54) ENVELOPE FEEDER WITH SELECTIVE SUCTION CUP ASSIST

(71) Applicant: Pitney Bowes Inc., Danbury, CT (US)

(72) Inventors: Xavier Padros, New Milford, CT (US); Boris Rozenfeld, Danbury, CT (US); Brad A Swinford, New Milford, CT (US)

(73) Assignee: DMT Solutions Global Corp., Danbury, CT (US)

( * ) Notice: Subject to any disclaimer, the term of this patent is extended or adjusted under 35 U.S.C. 154(b) by 54 days.

(21) Appl. No.: 15/040,015

(22) Filed: Feb. 10, 2016

(65) Prior Publication Data

US 2016/0244286 A1 Aug. 25, 2016

Related U.S. Application Data

(60) Provisional application No. 62/118,571, filed on Feb. 20, 2015.

(51) Int. Cl.
*B65H 3/08* (2006.01)
*B65H 3/04* (2006.01)
(Continued)

(52) U.S. Cl.
CPC ..... *B65H 3/0808* (2013.01); *B65H 3/045* (2013.01); *B65H 3/047* (2013.01); *B65H 3/56* (2013.01);
(Continued)

(58) Field of Classification Search
CPC .. B65H 3/0808; B65H 3/0816; B65H 3/0833; B65H 3/045; B65H 3/047; B65H 2301/1422; B65H 2301/44336; B65H 2301/44724; B65H 2406/342; B65H 2406/3622; B65H 2406/3632; B65H 2511/22; B65H 2511/33; B65H 2511/529; B65H 2513/102; B65H 2513/106; B65H 2513/511; B65H 2601/12; B65H 2701/1916
USPC ..... 271/2, 4.03, 94, 96, 102, 105, 106, 107, 271/31.1
See application file for complete search history.

(56) References Cited

U.S. PATENT DOCUMENTS 4,541,624 A * 9/1985 Sasage ..... B07C 1/02 198/572
4,757,985 A * 7/1988 Hamant ..... B65H 1/025 271/146
(Continued)

FOREIGN PATENT DOCUMENTS

EP 1746056 A1 1/2007
EP 1746058 A1 1/2007
JP 02231329 9/1990

*Primary Examiner* — Ernesto A Suarez
(74) *Attorney, Agent, or Firm* — Michael J. Cummings; Charles R. Malandra, Jr.

(57) ABSTRACT

The novel solution provides a method for feeding of individual envelopes from a stack of envelopes in a hopper for an inserter machine. At the downstream end of the hopper, a friction feeder serially feeds individual envelopes from the stack. A suction cup is selectively actuated to engage with the envelope to pull a leading portion of the envelope away from the stack to assist the friction feeder in feeding envelopes. Selective actuation is based on monitoring downstream movement of fed envelopes. The suction cup is engaged when the envelopes travel a shorter distance than would be expected based on the movement of the feeder.

8 Claims, 2 Drawing Sheets

(51) Int. Cl.
*B65H 3/56* (2006.01)
*B65H 7/06* (2006.01)

(52) U.S. Cl.
CPC ..... *B65H 7/06* (2013.01); *B65H 2406/342* (2013.01); *B65H 2511/22* (2013.01); *B65H 2511/414* (2013.01); *B65H 2513/512* (2013.01); *B65H 2601/12* (2013.01); *B65H 2701/1916* (2013.01)

(56) References Cited

U.S. PATENT DOCUMENTS 5,016,865 A * 5/1991 Ioka ..... B65H 3/0808 271/103
5,052,672 A * 10/1991 Horii ..... B65H 3/0833 271/107
5,219,432 A * 6/1993 Delbe ..... B07C 1/025 271/103
5,527,028 A * 6/1996 Ishikawa ..... B65H 1/266 271/114
5,899,449 A * 5/1999 Acquaviva ..... B65H 3/128 271/107
6,176,481 B1 * 1/2001 Ohkoda ..... B65H 3/0833 271/111
6,250,625 B1 6/2001 Janatka
6,425,579 B1 7/2002 Andreyka
7,926,807 B2 * 4/2011 Dahlgren ..... B65H 3/0816 271/262
2007/0018377 A1 * 1/2007 Rozenfeld ..... B43M 3/04 271/99

* cited by examiner

ENVELOPE FEEDER WITH SELECTIVE SUCTION CUP ASSIST

FIELD OF THE INVENTION

The present invention relates generally to a document inserting systems, which assemble batches of documents for insertion into envelopes. More particularly, the present invention is directed toward an envelope feeder for serially feeding individual envelopes from a stack of envelopes.

BACKGROUND OF THE INVENTION

Multi-station document inserting systems generally include a plurality of various stations configured for specific applications. Such machines are known in the art and are generally used by organizations, which produce a large volume of mailings where the content of each mail piece may vary.

In a typical envelope insertion machine for mass mailing, there is a gathering section where the enclosure material is gathered before it is inserted into an envelope. This gathering section includes a gathering transport with pusher fingers rigidly attached to a conveying means and a plurality of enclosure feeders mounted above the transport. If the enclosure material contains many documents, these documents are separately fed by different enclosure feeders. After all the released documents are gathered, they are put into a stack to be inserted into an envelope in an inserting station.

At the same time, envelopes are sequentially fed to the inserting station, and each envelope is placed on a platform with its flap flipped back all the way, so that a plurality of mechanical fingers or a vacuum suction device can keep the envelope on the platform while the throat of the envelope is pulled away to open the envelope.

Before envelopes are fed to the insertion station, they are usually supplied in a stack in a supply tray or envelope hopper. Envelopes are then separated by an envelope feeder so that only one envelope is fed to the insertion station at a time. For that reason, an envelope feeder is also referred to as an envelope singulator. In a high-speed insertion machine, the feeder should be able to feed single envelopes at a rate of approximately 18,000 No. 10 envelopes per hour. At this feeding rate, it is critical that only a single envelope at a time is picked up and delivered to the insertion station.

However, deformed envelopes (cupped or twisted) degrade performance of the feeder. Such deformation can result in slippage that causes the envelopes to be fed too slowly. Slippage may also result, for example, from insufficient pressure on the envelope stack, or from envelopes made from a material that has low friction. A prior solution to this problem involved using a suction cup to assist in feeding the envelopes. However, constant use of the suction cup involves additional risks of misfeeds and jams.

At a feeding period approximately equal to 200 ms, there are roughly 30 ms available for the feeder to reset before the next feed cycle is initiated. If an envelope is not present in close proximity before the next feed time, acquisition of the next envelope will not occur and a feed cycle will be missed, resulting in a reduced machine throughput.

Known envelope feeder systems for an inserter system are described in U.S. Pat. No. 6,250,625, Method for Supplying Envelopes to an Inserter System by Way of Multiple Paths, and U.S. Pat. No. 6,425,579, Low Friction Envelope Feeder, which are hereby incorporated by reference.

SUMMARY OF THE INVENTION

To avoid the problems inherent in the prior art, the proposed solution measures the quality of the feeding and activates the suction cup mechanism only when it is required. Accordingly, the instant invention provides a method for feeding of individual envelopes from a stack. Envelopes are stacked in a hopper, the hopper having an upstream end and a downstream end. At the downstream end of the hopper, a friction feeder serially feeds individual envelopes from the stack. A suction cup is selectively actuated to engage with the envelope to pull a leading portion of the envelope away from the stack to assist the friction feeder in feeding envelopes.

Preferably, vacuum is selectively applied and removed from the suction cup in order to release the envelope for further feeding by the friction feeder. The step of selective actuation is preferably based on monitoring downstream movement of fed envelopes. The suction cup is engaged when the envelopes travel a shorter distance than would be expected based on the movement of the feeder. This difference is based on slippage from poor feeding by friction feeder. The suction cup is engaged when envelopes fail to travel a distance set as a predetermined threshold. Preferably, the suction cup is engaged for a predetermined number of subsequent envelopes after the predetermined threshold is not met.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
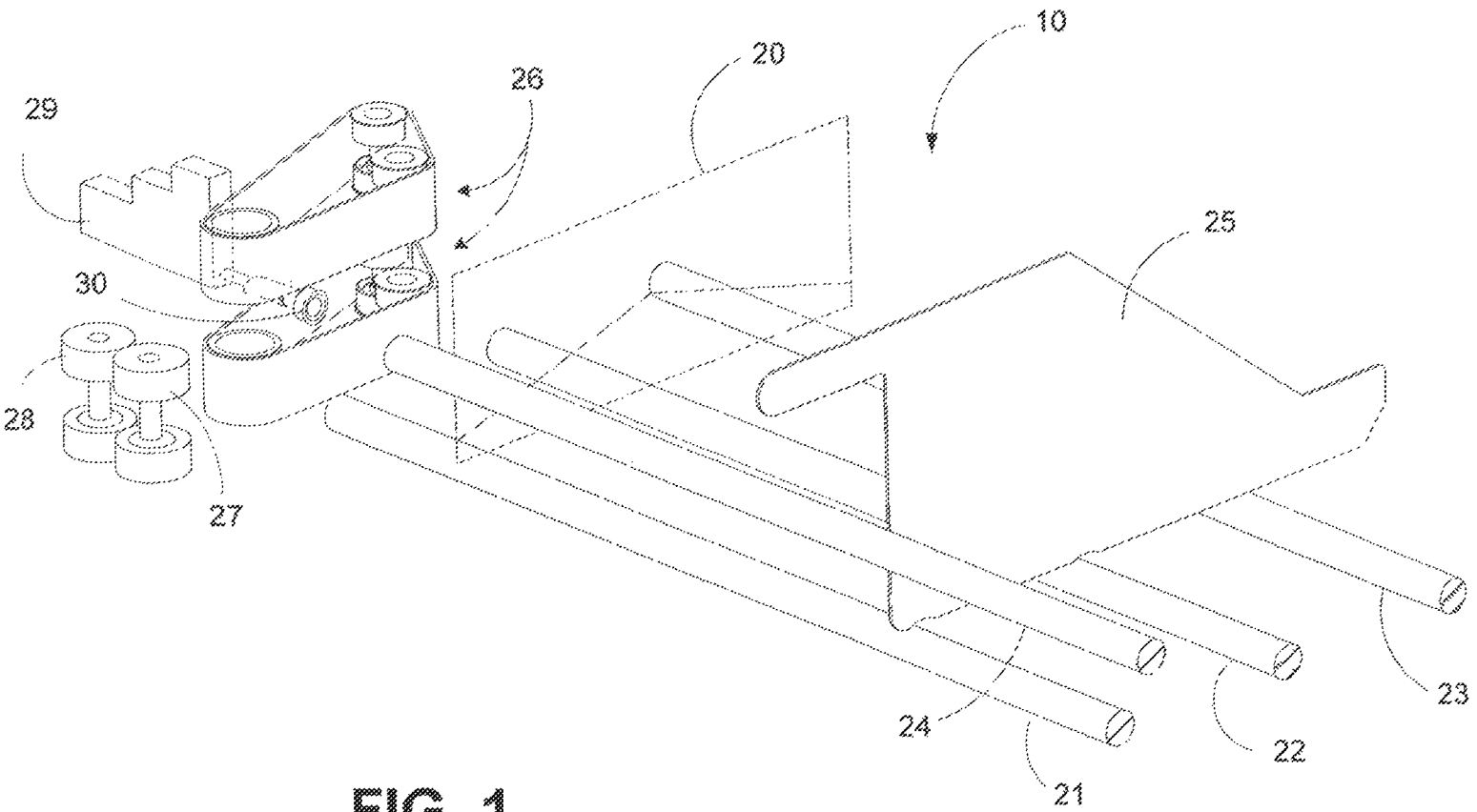
FIG. 1 is an isometric view of the hopper and feeder in accordance with the present invention.
Figure 2:
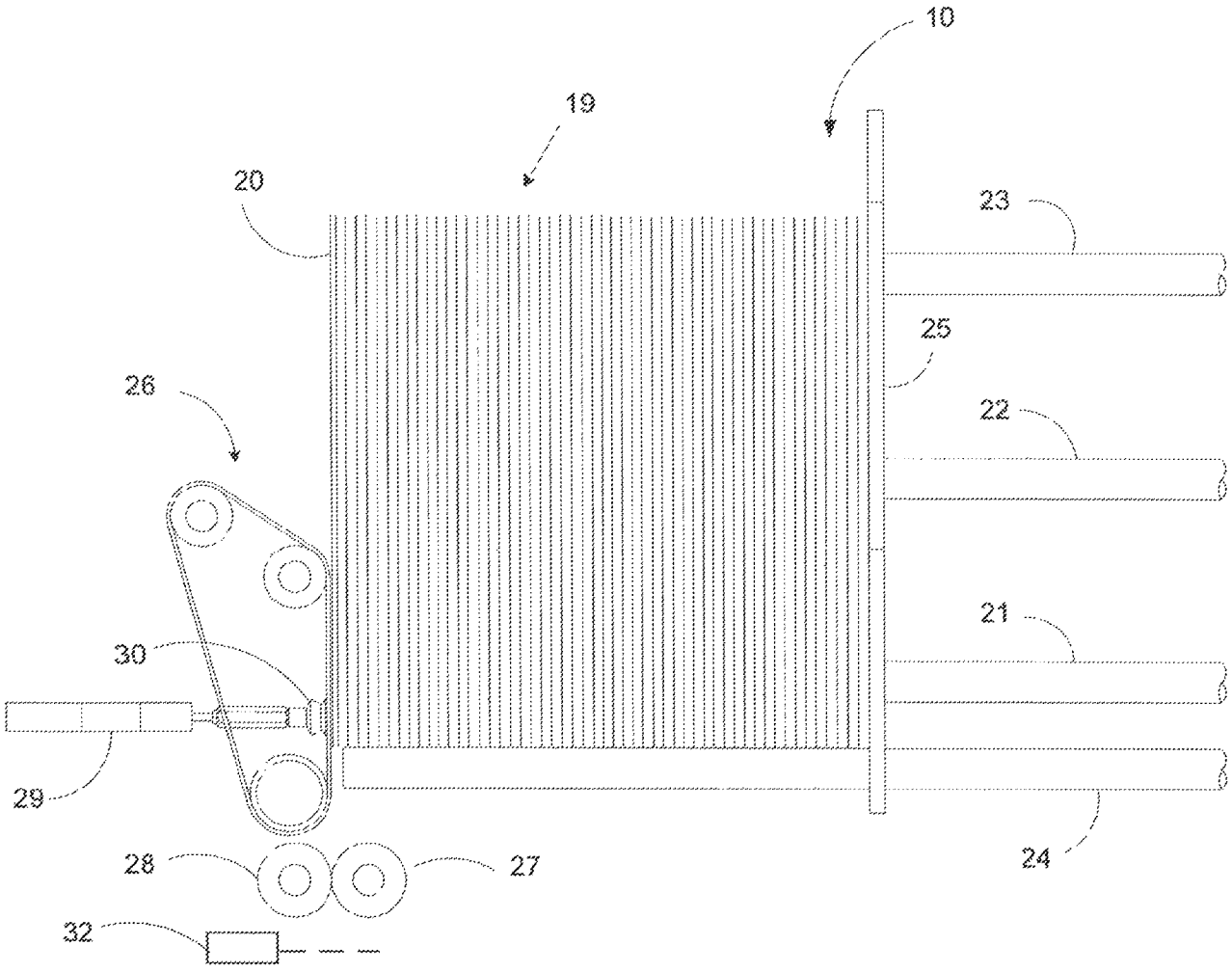
FIG. 2 is a top view of the hopper and feeder in accordance with the present invention.

FIGS. 1 and 2 illustrate the envelope hopper 10 used with the present invention. As shown, the envelope hopper 10 includes a plurality of polished, bottom rods 21-23 for supporting a stack 19 of envelopes 20 and providing the envelopes 20 to an envelope feeder 26 at the downstream end of the envelope hopper 10. The rods 21-23 form a supporting surface below the stack 19. Preferably, the envelope hopper 10 is tilted to the left such that the supporting surface is tilted at an angle to facilitate movement of the stack 19 towards the feeder 26, and for feeding. A polished, side rod 24 is provided above the supporting surface on the left-side of the envelope hopper 10 to register the left edge of the envelopes 20. An envelope pusher assembly 25 provides pressure on the stack 19, towards the feeder 26.

At the downstream end of the hopper 10, the feeder 26 is preferably a friction belt that pulls and singulates envelopes into a driven feed nip formed by rollers 27 and 28. In feeder 26, during every cycle the feed belts separate a single envelope 20 out of the stack 19 and move it into the take away nip rollers 27, 28. Feeder 26 further includes an encoder that tracks the motion of the feeder for each envelope, whereby a nominal transport distance caused by the feeder 26 is known (not taking slippage into account).

A suction cup 30 is positioned proximally to the feeder 26 to assist in feeding of envelopes 20. The suction cup actuator 29 causes the suction cup 30 to move forward to engage the surface of the leading portion of envelope 20. The actuator 29 then pulls the suction cup 30 and the leading portion of envelope 20 away from the stack 19. The vacuum to the suction cup 30 is then cut off by an air valve, as the feeder 26 belt, and take away nip rollers 27,28 feed the singulated envelope 20.

The quality of the feeder 26 performance is measured by comparing the measured feed distance versus the nominal feed distance. The measured feed distance is the distance the feed belts move from starting acceleration to the moment when the leading edge of the envelope 20 arrives at the location of the feed confirm sensor 32 (at this point leading edge of the envelope is downstream from the pinch point of take away nip roller 27, 28). The nominal feed distance is the distance between the bottom wall of the hopper 10 and feed confirm sensor 32. If the feeder 26 is working ideally, the measured feed distance should be the same as the nominal distance. But due to slippage, the distance feed belts travel to the moment the envelope arrives at the feed confirm sensor may be longer than the nominal distance.

In accordance with the improved system described herein, the feed distance is monitored every cycle and compared to a maximum allowed distance for particular material size. If the feed distance is lower than a threshold value the suction cup mechanism 29, 30 stays deactivated. If the feed distance exceeds the threshold value the suction cup mechanism 29, 30 is activated for N consecutive cycles. After N cycles are expired the control algorithm deactivates the suction cup mechanism. "N" is a configurable number that can be set in advance.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A method for feeding of individual envelopes from a stack, the method comprising:
- stacking envelopes in a hopper, the hopper having an upstream end and a downstream end;
- at the downstream end of the hopper, serially feeding individual envelopes from the stack using a friction feeder;
- selectively actuating a suction cup to engage with the envelope to pull a leading portion of the envelope away from the stack to assist the friction feeder in feeding envelopes; and
- wherein the step of selective actuation Is based on monitoring downstream movement of fed envelopes, and wherein the suction cup is engaged when the envelopes travel a shorter distance than would be expected based on the movement of the feeder.

2. The method of claim 1 further Including removing vacuum from the suction cup in order to release the envelope for further feeding by the friction feeder.

3. The method of claim 1 wherein the suction cup is engaged when envelopes fail to travel a distance set as a predetermined threshold.

4. The method of claim 3 wherein the suction cup is engaged for a predetermined number of subsequent envelopes after the predetermined threshold Is not met.

5. An apparatus for feeding of Individual envelopes from a stack, the apparatus comprising:
- a hopper for holding a stack of envelopes, the hopper having an upstream end and a downstream end;
- a friction feeder at the downstream end of the hopper, serially feeding individual envelopes from the stack;
- a suction cup mechanism that is selectively actuatable to engage with the envelope to pull a leading portion of the envelope away from the stack to assist the friction feeder in feeding envelopes; and
- wherein the friction feeder includes an encoder for measuring a distance that a fed envelope has nominally been transported, and an optical sensor that detects an actual position of the envelope at a particular point downstream, and wherein the suction cup mechanism, in operative communication with the encoder and the optical sensor, is configured to engage when the envelopes travel a shorter measured distance than would be expected based on the movement of the feeder measured by the encoder.

6. The apparatus of claim 5 wherein the suction cup mechanism includes a valve for removing vacuum from a suction cup in order to release the envelope for further feeding by the friction feeder.

7. The apparatus of claim 5 wherein the suction cup mechanism, in operative communication with the encoder and the optical sensor, is configured to engage when envelopes fail to travel a distance set as a predetermined threshold, based on the comparison of the actual distance traveled compared to the distance expected for travel based on the feeder encoder.

8. The apparatus of claim 7 wherein the suction cup mechanism, in operative communication with the encoder and the optical sensor, is configured to engage for a predetermined number of subsequent envelopes after the predetermined threshold is not met.

* * * * *